US011191994B2

(12) United States Patent
Dreytser

(10) Patent No.: US 11,191,994 B2
(45) Date of Patent: Dec. 7, 2021

(54) SYSTEM AND METHOD OF TREATMENT USING A UNIVERSAL CAGE APPARATUS

(71) Applicant: Marina Feldman Dreytser, Marlboro, NJ (US)

(72) Inventor: Marina Feldman Dreytser, Marlboro, NJ (US)

( * ) Notice: Subject to any disclaimer, the term of this patent is extended or adjusted under 35 U.S.C. 154(b) by 0 days.

(21) Appl. No.: 17/010,977

(22) Filed: Sep. 3, 2020

(65) Prior Publication Data

US 2020/0398101 A1 Dec. 24, 2020

Related U.S. Application Data

(62) Division of application No. 15/989,893, filed on May 25, 2018, now abandoned.
(Continued)

(51) Int. Cl.
*A63B 21/16* (2006.01)
*A61G 7/05* (2006.01)
(Continued)

(52) U.S. Cl.
CPC ..... *A63B 21/16* (2013.01); *A61G 7/05* (2013.01); *A61G 10/00* (2013.01);
(Continued)

(58) Field of Classification Search
CPC ... A63B 71/022; A63B 21/16; A63B 21/0624; A63B 21/156; A63B 21/00181;
(Continued)

(56) References Cited

U.S. PATENT DOCUMENTS 6,705,976 B1 3/2004 Piane
9,700,751 B2 * 7/2017 Verdi ..... A63B 21/025
(Continued)

FOREIGN PATENT DOCUMENTS

BR 102013025926 * 12/2015
CN 201727876 U 2/2011
(Continued)

OTHER PUBLICATIONS https://pediasuitbrasil.com.br/index.php/pt-br/noticias/fotos (Oct. 2, 2014 and Nov. 26, 2014) (Year: 2014).*
(Continued)

*Primary Examiner* — Andrew S Lo
*Assistant Examiner* — Andrew M Kobylarz
(74) *Attorney, Agent, or Firm* — Werschulz Patent Law, LLC; Patricia P. Werschulz, Esq.

(57) ABSTRACT

A system and a method of treatment using a universal cage creating a coordinate method of exercise. Physical therapy or fitness exercises are provided to a patient through a system of cords, blocks and belts disposed on a plurality of grid panels through a plurality of mounting devices. Placement of the mounting devices on the grid panel is determined by which muscle groups are receiving therapy and the type of movement required. Once the placement for each movement is determined, the coordinates of the mounting device are captured so that the mounting devices can be preset consistently for each therapy session.

5 Claims, 6 Drawing Sheets

Related U.S. Application Data

(60) Provisional application No. 62/512,006, filed on May 27, 2017.

(51) Int. Cl.
*A63B 21/062* (2006.01)
*A63B 21/00* (2006.01)
*A61G 10/00* (2006.01)

(52) U.S. Cl.
CPC .... *A63B 21/00181* (2013.01); *A63B 21/0622* (2015.10); *A63B 21/0624* (2015.10); *A63B 21/156* (2013.01); *A61G 2200/327* (2013.01); *A61G 2205/20* (2013.01); *A61G 2205/50* (2013.01); *A63B 2208/0252* (2013.01)

(58) Field of Classification Search
CPC ..... A63B 21/0622; A63B 2208/0252; A63B 2071/0691; A63B 2071/0694; A63B 2208/0233; A61G 10/00; A61G 7/05; A61G 2205/50; A61G 2200/327; A61G 2205/20; A61G 1/00; A61H 1/02; A61H 1/0218; A61H 1/0274; A61H 2203/0481; A61H 2201/163; A61H 2203/0431; A61H 2201/0142; A61H 2201/1261; A61H 2201/1638; A61H 2203/0456; A61H 2201/1652
See application file for complete search history.

(56) References Cited

U.S. PATENT DOCUMENTS

| | | | | |
|---|---|---|---|---|
| 2013/0274074 | A1 | 10/2013 | Ghandour | |
| 2015/0367158 | A1* | 12/2015 | Pretz | A63B 69/002 482/129 |
| 2017/0056702 | A1* | 3/2017 | Carter | A63B 21/153 |
| 2019/0118022 | A1* | 4/2019 | Carter | A63B 21/0087 |

FOREIGN PATENT DOCUMENTS

| | | | |
|---|---|---|---|
| CN | 203226997 | U | 10/2013 |
| CN | 103584992 | B | 4/2015 |

OTHER PUBLICATIONS

Anonymous, Universal Exercise Unit, TheraSuit Method: The New Standard in Treatment for Cerebral Palsy, May 2, 2017, 11:20 AM (last visited Jun. 6, 2018), Keego Harbor, MI 48320 USA, http://www.suittherapy.com/ueu.htm.

https://pediasuitbrasil.com.br/index.php/pt-br/noticias/fotos (Oct. 2, 2014 and Nov. 26, 2014).

https://www.facebook.com/universalcagetherapynj/ May 13, 2017.

* cited by examiner

SYSTEM AND METHOD OF TREATMENT USING A UNIVERSAL CAGE APPARATUS

CROSS-REFERENCE TO RELATED APPLICATIONS

This application is a divisional non-provisional utility application of the nonprovisional utility application, Ser. No. 15/989,893 filed on May 25, 2018, claiming priority to the provisional patent application, Ser. No. 62/512,006, filed in the United States Patent Office on May 27, 2017, and claims the priority thereof and is expressly incorporated herein by reference in its entirety.

TECHNICAL FIELD

The present disclosure relates generally to a method of physical therapy treatment. More particularly, the present disclosure relates to a system and a method of physical therapy treatment using a universal cage apparatus.

BACKGROUND

Physical therapists with special training deliver therapy using a system sometimes referred to as a universal cage (UC) or a universal exercise unit or UEU. The UEU has a system of a system of pulleys, straps and splints utilized to perform a variety of exercises. A major goal is to improve strength, AROM (active range of motion) and muscle flexibility. Through the system of pulleys and straps, the therapist can isolate any muscle group and target it.

A disadvantage of the known methods using UC is that before each session of therapeutic exercise or any other therapeutic procedure it is necessary to determine the correct angle of resistance and then place the hangers, brackets of the pulleys and blocks accordingly on the walls of the unit. This increase the duration of the session and consequently the cost of treatment.

Additionally, a physical therapist is required to be present during the therapy session which precludes a patient or a paraprofessional administering the therapy without the direct supervision of a physical therapist.

While these methods may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

The present disclosure describes a system and a method of treatment using a universal cage. Physical therapy is provided to a patient through a system of cords, blocks and belts disposed on a plurality of panels attaching to a plurality of mounting devices. Similarly, fitness exercises can be provided through the same system. Placement of the mounting devices on the panels is determined by which muscle is receiving therapy or exercise and the type of movement required. Once the placement for each movement is determined, the coordinates of the mounting device are captured on a map so that the mounting devices can be preset consistently for each motion and for each therapy or exercise session.

Each type of exercise uses its own pre-arranged panels in the cage, each exercise having a combination of a horizontal code, a vertical code on the panel where the fastening device is placed based on the standard coordinates from the list of exercises. For individual modifications or when of a new kind of training is to be added in the future, new standard coordinates are mapped and added to the list. The location of the table or chair for placing the patient is generally fixed on the floor in relationship to panels of the cage and can in certain limits be adjusted depending on the type of procedure, and if necessary, the anthropometric characteristics of the patient.

The present disclosure addresses at least one of the known disadvantages known to those of ordinary skill in the art. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
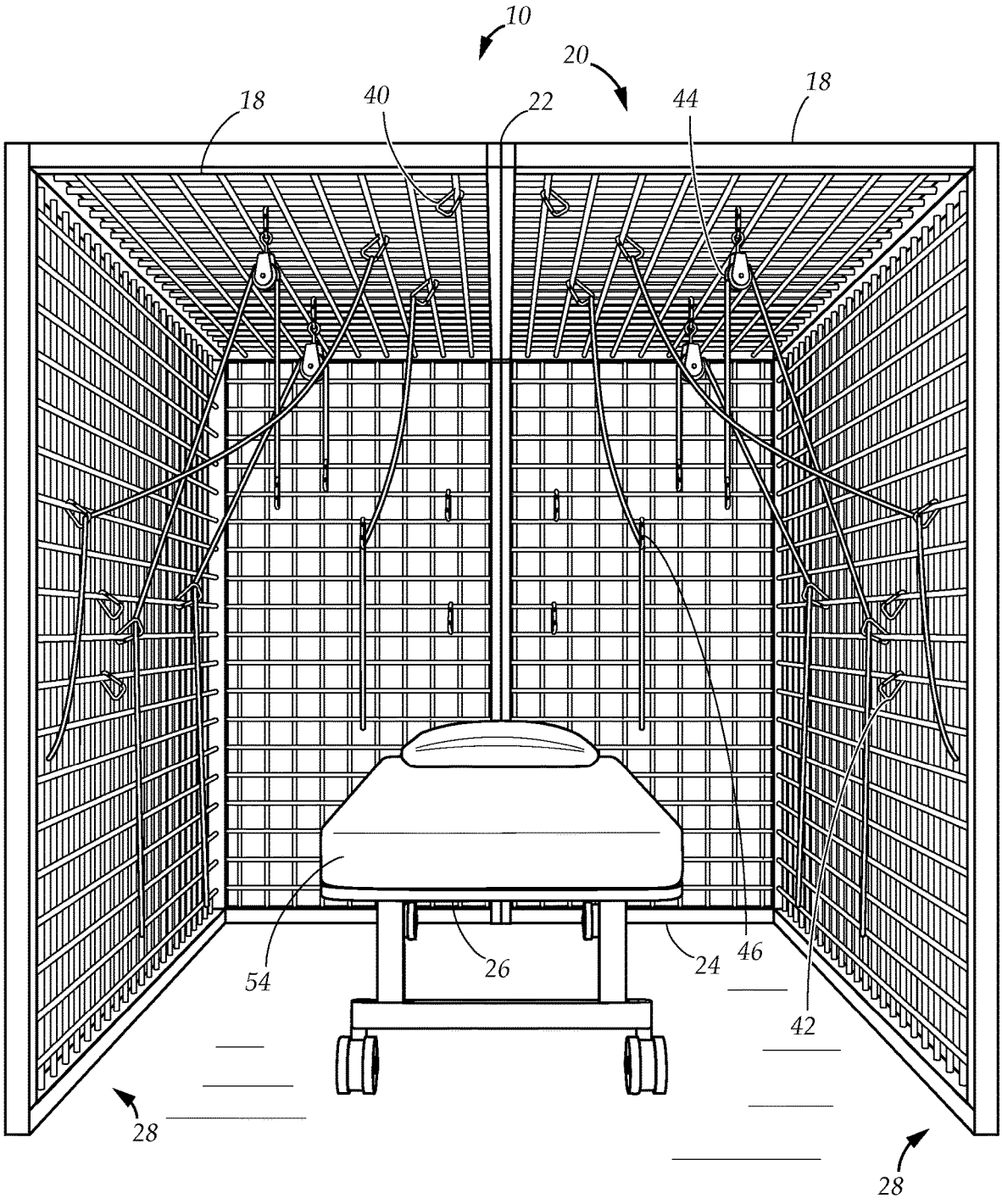
FIG. 1 is a perspective view of an example embodiment of a universal cage in a system disclosed herein.
Figure 2:
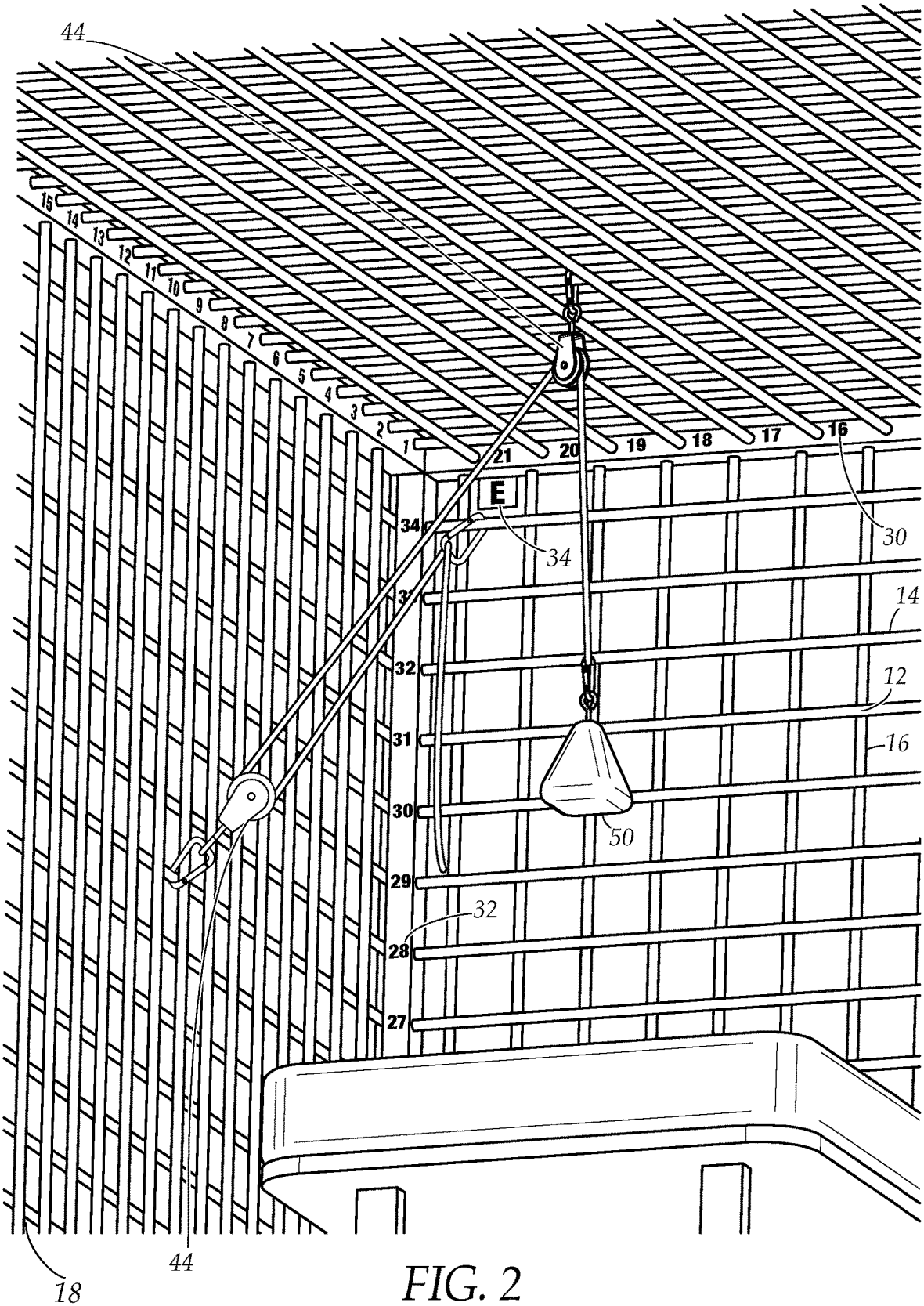
FIG. 2 is a perspective view in detail of a section of the example embodiment of the universal cage.

FIGS. 1 and 2 show an example embodiment of a system and a method employing a universal cage 10 with a plurality of mounting devices 40 for a plurality of cords 48 attaching to a plurality of weights 50, the mounting devices 40 mounting on a plurality of panels 18. The system and method are useful for physical therapy as well as general fitness.

The universal cage 10 having a plurality of intersections 12 formed by a plurality of horizontal rods 14 intersecting a plurality of vertical rods 16, each intersection 12 identified by a pair of codes, a horizontal code 32 identifying the horizontal rod 14 and a vertical code 30 identifying the vertical rod 16 intersecting the horizontal rod 14. The mounting devices 40 are placed on the intersections 12 of the universal cage 10.

The universal cage 10 has a pair of side walls 28, a rear wall 24 and a ceiling 20, each of the side walls 28, the rear wall 24 and the ceiling 20 having two panels 18. Each of the six panels 18 has an indicium 34 as unique identifier. Each intersection 12 of horizontal rods 14 intersecting vertical rods 16 in the universal cage 10 can be uniquely identified by the pair of codes combined with the indicium 34 of the panel 18 each intersection 12 is located on.

The cords 48 attach to the mounting devices. The cords 48 each have a pair of ends, a first end of the cords 48 attaching to a patient and a second end attaching to a weight 50. The mounting devices 40 are selected from the group consisting of carabiners 42, pulleys 44 and brackets 46.

The mounting devices 40 are placed symmetrically throughout the universal cage 10. The mounting devices 40 on a first wall is directly opposite the mounting devices 40 of the second wall, the mounting devices 40 on a first panel 18 of the ceiling 20 are equidistant from a center 22 of the ceiling 20 where the panels 18 are conjoined and equidistant from the rear wall 24, the mounting devices 40 on a first panel 18 of the rear wall 24 equidistant from a center 26 of the rear wall 24 where the panels 18 are conjoined and equidistant from a floor.

The system includes a map for positioning the mounting devices, the map indicating coordinates that includes the horizontal code 32, the vertical code 30 and the panel indicium 34 for providing physical therapy to a specified portion of a specified muscle for movement through a specified range of motion. While the map can be represented visually on a grid, it also can be represented in a listing such as shown below in Table 1. (Please note that these are listings are illustrative only and may vary from one universal cage 10 to another depending on the size and manufacturer.)

TABLE 1

| Muscle | Position on Muscle | Panel for Resistance | Vertical Code | Horizontal Code |
|---|---|---|---|---|
| Lateral antebrachial | Mid-point | F | 20 | 18 |
| Medial antebrachial | Mid-point | E | 21 | 16 |
| Medial antebrachial | Distal end | E | 21 | 12 |

Every skeletal muscle can be mapped to the universal cage 10. Varying the position on the muscle varies the torque, the more distal end of attachment providing more torque.

Figure 4:
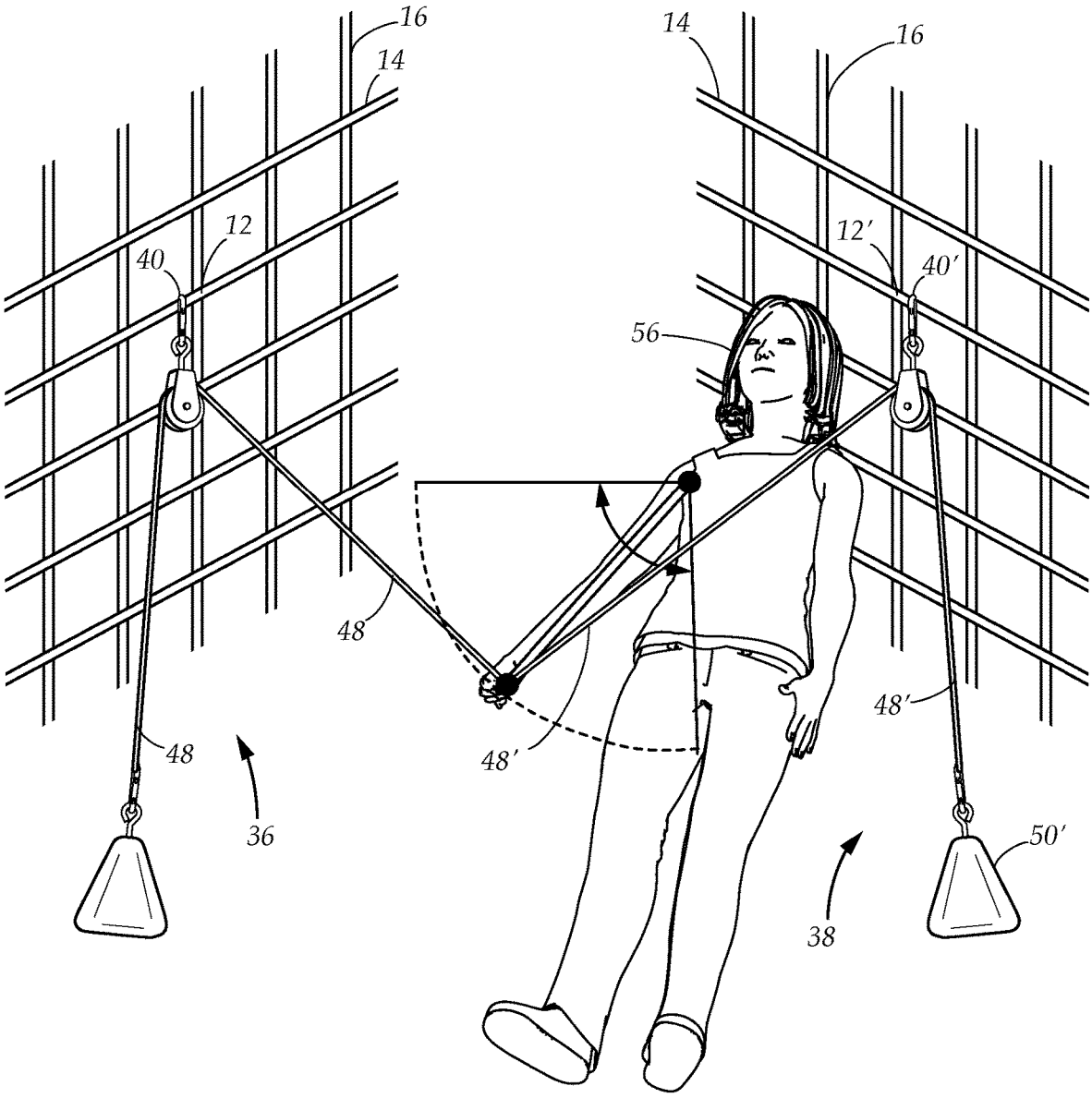
FIG. 4 is a diagram showing an example embodiment of a resistance module and an assistance module.

FIG. 4 shows further elements of the system. The system further comprises a resistance module 36 having a first end of a first cord 48 attaching to the specified portion of the specified muscle for the specified range of motion, attaching to at least one mounting device 40 positioned as indicated on the map and attaching a first weight 50 to the second end of the first cord 48 and an assistance module 38 having a first end of a second cord 48' attaching to the specified portion of the specified muscle for the specified range of motion, attaching to the mounting device 40' positioned opposite the mounting device 40 of the resistance module 36 as indicated on the map and attaching to a second weight 50' to the second end of the second cord 48', the second weight 50' lighter than the first weight 50 in the resistance module 36. The resistance module 36 and assistance module 38 are symmetrically placed on the universal cage 10 but asymmetrically weighted.

Figure 5:
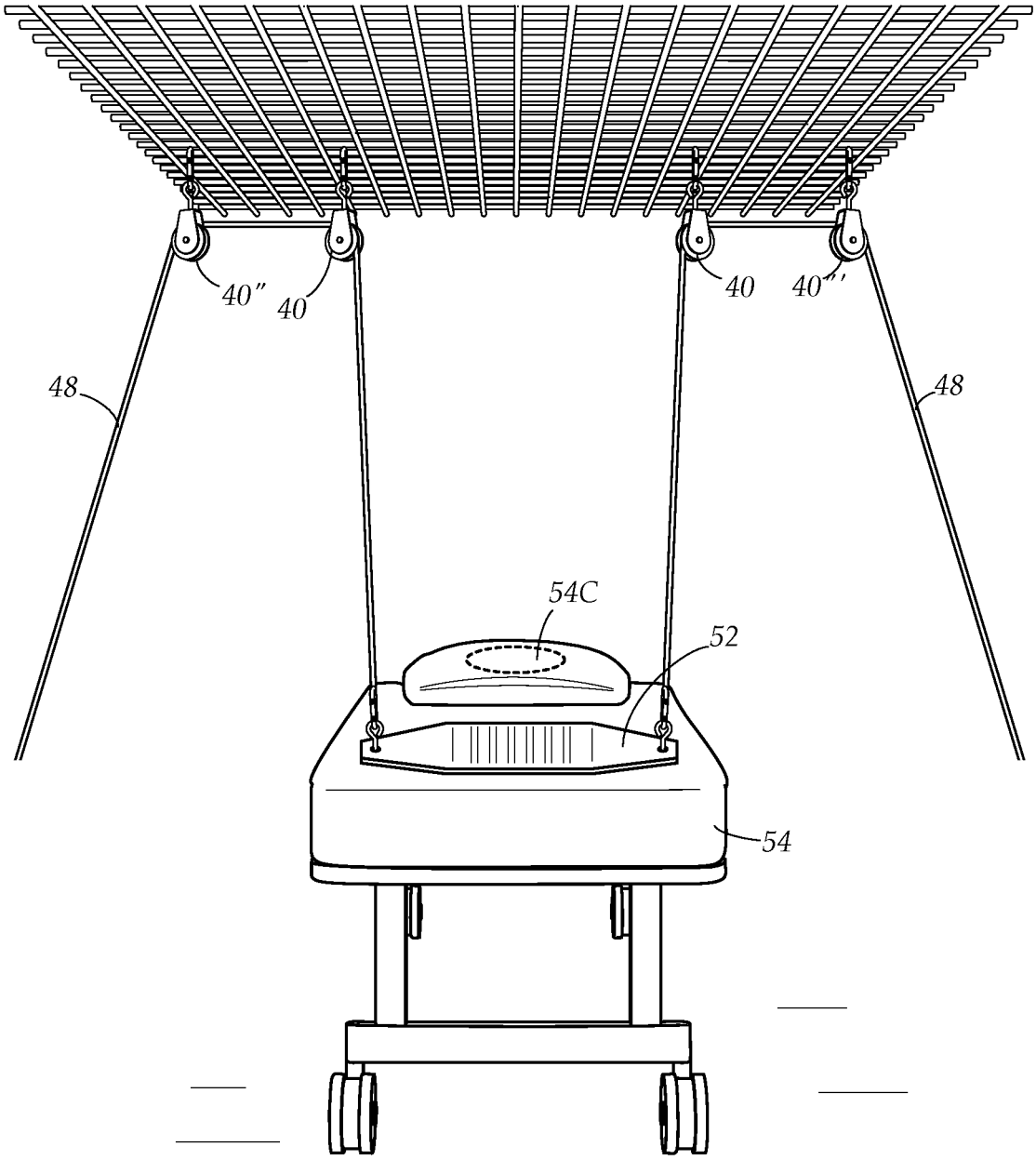
FIG. 5 is a perspective view of a gurney inside an example embodiment of the universal cage.

In one example embodiment, as shown in FIG. 5, the resistance module 36 and assistance module 38 use two mounting devices 40, 40" on the panel 18 forming a block. The cord 48 attaches to the patient with the pulley attaching to the bracket, which is not shown in this illustration. The second mounting device 40" is associated with the first mounting device 40 in the map.

FIGS. 1 and 5 shows further elements of the system. A gurney 54 is selectively placed centrally between the side walls 28 by aligning a center of the gurney 54 with a center 26 of the rear wall 24 where the two rear panels 18 are conjoined. A belt 52 for suspending the patient 56 placed on the gurney 54 during therapy is provided. The belt 52 is suspended from the ceiling panels 18 by mounting devices 40 symmetrically placed according the map for providing support to a specific portion of a patient 56. As a non-limiting example, the belt 52 may be placed below the back or hip to support the spine or below an arm for support during arm exercises. The ceiling panels 18 are mapped for placing the mounting devices 40 for suspending the belt 52.

It is understood by those of ordinary skill in the art that a chair can be substituted for the gurney 54 if the treatment requires the patient to be sitting upright during the therapy. The chair is aligned to be symmetrically between the two side walls 28 and placed substantially in the center of the cage.

Figure 6:
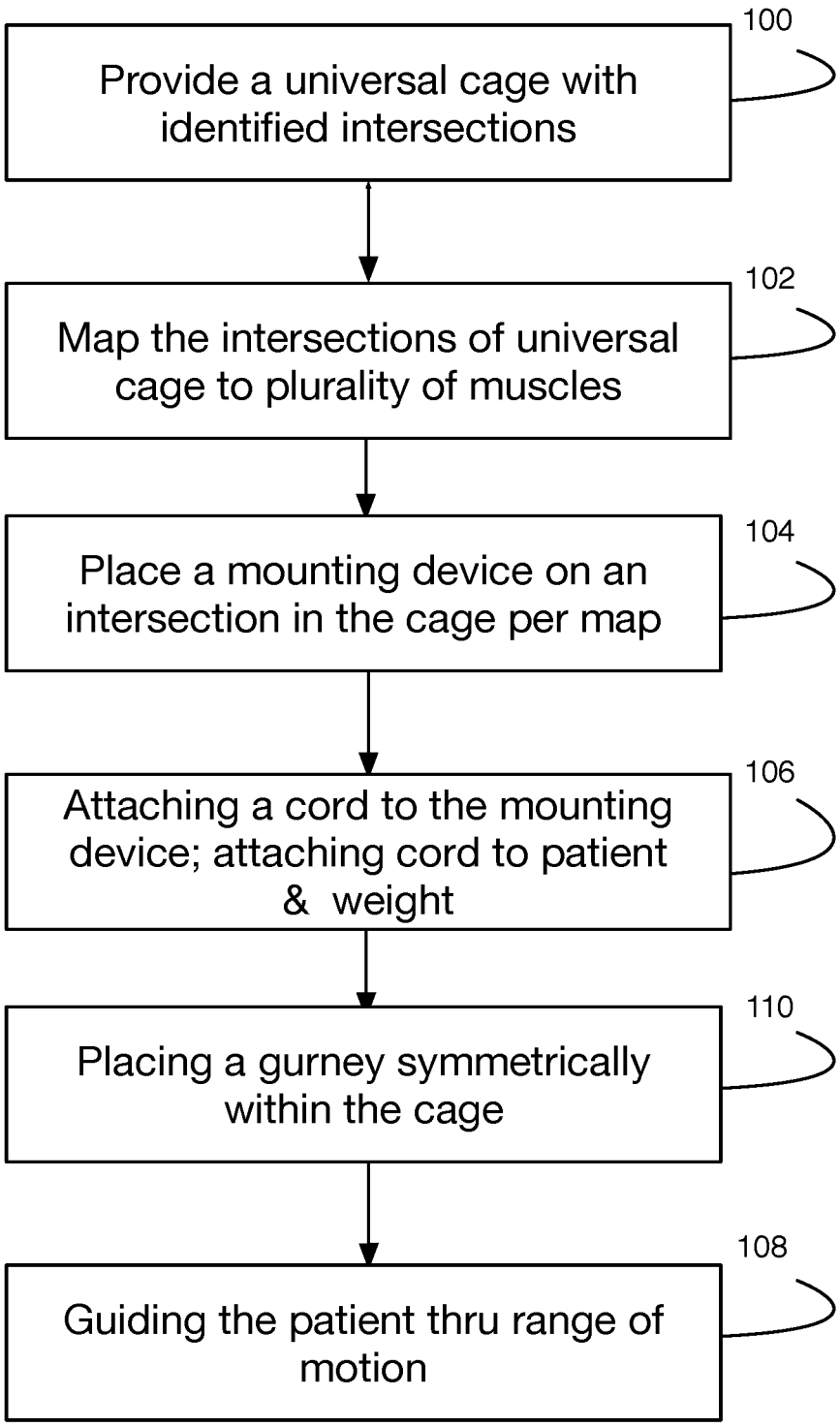
FIG. 6 is a block diagram representing a method herein disclosed.

The method of providing physical therapy or a fitness regimen is presented in FIG. 6 referring to the devices in FIGS. 1-5 illustrating the system.

The method of physical therapy uses the universal cage 10 in which each desired movement of a specific muscle is predetermined by using at least one mounting device 40 which is strictly positioned in advance at the appropriate intersections 12 of the universal cage 10 reflecting the angle of resistance for the therapeutic exercise for the specific muscle.

The first step 100 is providing the universal cage 10 having the pair of side walls 28, the rear wall 24 and the ceiling 20, each of the side walls 28, the rear wall 24 and the ceiling 20 having two panels 18 uniquely identified by the panel indicium 34, the intersections 12 on the panels 18 formed by the horizontal rods 14 intersecting the vertical rods 16, each intersection 12 identified by the pair of codes, the horizontal code 32 identifying the horizontal rod 14 intersecting the vertical rod 16 identified by the vertical code 30.

The cage in FIG. 1 comprises the panels 18 constructed from horizontal rods 14 at right angles to the vertical rods 16 creating a grid having intersections 12 at each point where the horizontal rods intersect with the vertical rods. The cage has at least one, preferably two panels 18 on each side and at least one, preferably two panels 18 connecting the side walls 28 forming a rear wall 24. At least one, preferably two panels 18 are overhead connecting at the top of walls forming a ceiling 20.

The next step 102 is mapping the universal cage 10 for positioning the mounting devices 40 on the intersections 12 creating the map, the map indicating the horizontal code 32, the vertical code 30 and the panel indicium 34 for providing physical therapy to the specified portion of the specified muscle for movement through the specified range of motion.

The cage is mapped out with coordinates using codes. The codes can be expressed in an alphanumeric system, such as numbers and letters, or using other symbolic coding systems such as pictograms, logograms and colors. Each panel 18 has a unique indicium 34 and each intersection 12 on each panel 18 has a vertical code 30 and a horizontal code 32. FIG. 2 shows one system of mapping the coordinates. Shown is panel indicium 34 for Panel E 18. The horizontal rods 14 are numbered from 1 (one) to 34 (thirty-four) and the vertical rods 16 are numbered from 1 (one) to 6 (six). As shown, one cord 48 is mounted to the panel 18 having the indicium E, at the intersection 12 of horizontal rod 14 having the horizontal code 32 twenty-seven (27) and vertical rod 16 having the vertical code 30 nine (9). This can be represented as E 27, 9.

Figure 3:
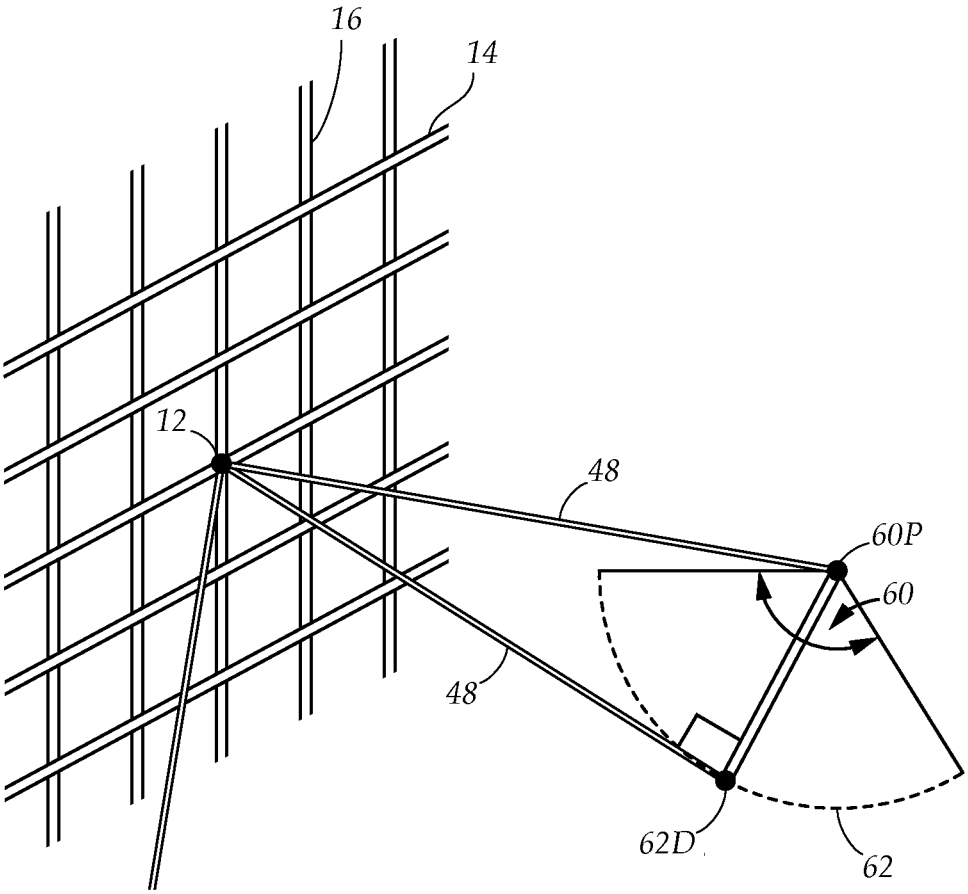
FIG. 3 is a diagram showing a mapping of an example embodiment of an exercise.

FIG. 3 shows how placement is determined for a specific muscle group. In order to treat and exercise multiple muscle groups, the coordinates predetermine the position of the exact placement of the mounting device 40. This assures a proper angle and expedites and facilitates an effective treatment. Placement of the mounting devices 40 follow known principles of kinesiology. The mounting devices 40 are placed substantially perpendicular to a line of movement at a half range of an arc. This creates a line of resistance to a muscle or muscle groups performing that arc of movement.

Before each type of movement in different planes, the mounting device 40 is placed on an intersection 12 of a pair of rods of the cage unit 104, according to a plurality of coordinates determined for all the horizontal rods 14 and the vertical rods 16. The selection of the appropriate anchoring points for mounting devices 40 is based on the mapping of the muscles.

The next step 106 is attaching the first cord 48 to at least one mounting device 40, the cord 48 having the pair of ends, the first end of the cord 48 attaching to the patient 56 and the second end attaching to the weight 50, at least one mounting device 40, the cord 48 and weight 50 forming a resistance module 36.

After the first cord 48 attaches to the at least one first mounting device 40, forming the resistance module 36, a second cord 48' is attaches to at least one second mounting device 40', the first end of the second cord 48' attaching to the patient 56 at the same place as the first cord 48 and the second end of the second cord 48' attaching to a second weight 50', the second weight 50' weighing less than the first weight 50, the at least one second mounting device 40', the second cord 48' and the second weight 50' forming an assistance module 38. The resistance module 36 and the assistance module 38 are placed symmetrically on the universal cage 10 but asymmetrically weighted.

The blocks are created by cords 48 placed symmetrically on each panel 18 of the cage at specified coordinates preset by mounting devices 40, 40" as well. These blocks are placed at those coordinates and used for all programs.

The at least one first mounting device 40 is placed on the first wall directly opposite the at least one second mounting device 40' on the second wall when the resistance module 36 and assistance module 38 is formed on the side panels 18. When the at least one first mounting device 40 is placed on the first panel 18 of the ceiling 20 and the at least one second mounting device 40' is placed equidistant from the center 22 of the ceiling 20 as the at least one first mounting device 40, the center 22 being where the ceiling panels 18 are conjoined and equidistant from the rear wall 24 as the at least one first mounting device 40. When the at least one first mounting device 40 is placed on the first panel 18 of the rear wall 24 and the at least one second mounting device 40' is placed equidistant from the center 26 of the rear wall 24 where the rear wall 24 panels 18 are conjoined as the at least one first mounting device 40 and equidistant from the floor as the at least one first mounting device 40.

When the gurney 54 is used, the gurney 54 is placed symmetrically 110 between the side walls 28 by aligning a center of the gurney 54 with the center 26 of the rear wall 24 where the two rear panels 18 are conjoined.

When the chair is used, the chair is aligned to be symmetrically between the two side walls 28 and placed substantially in the center of the cage.

The therapist or trainer guides a patient 56 through the specified range of motion of the specified portion of the specified muscle 108.

This method and system are advantageous because they allow the therapist to exactly reproduce the proper exercise for the same desired effect for each treatment session.

This not only produces better results but results in more efficiency in terms of time, use of equipment and patient comfort, which subsequently will reduce the cost of treatment. The patient's experience less delays and more time efficiency during treatment session, which results in higher compliance.

Once the universal cage 10 is set up, the therapist or trainer consults the map for each muscle. It is understood by those of ordinary skill that the method described hereinabove is useful for both providing therapy to a patient for the purpose of increasing range of motion after an injury or surgery but also to provide physical training for general fitness and to increase muscle strength.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a system and a method of physical therapy treatment using a universal cage apparatus. The disclosure is illustrated by example in the drawing figures, and throughout the written description. It should be understood that numerous variations are possible, while adhering to the inventive concept. Such variations are contemplated as being a part of the present disclosure.

What is claimed is:

1. A method of providing physical therapy treatment, comprising:

providing a universal cage having a pair of side walls, a rear wall and a ceiling, each of the side walls, the rear wall and the ceiling having a pair of panels uniquely identified by a panel indicium, a plurality of intersections on the panels formed by a plurality of horizontal rods intersecting a plurality of vertical rods, each intersection identified by a pair of codes, a horizontal code identifying the horizontal rod intersecting the vertical rod identified by a vertical code;

mapping the universal cage for positioning a plurality of mounting devices on the intersections creating a map, the map indicating the horizontal code, the vertical code and the panel indicium for providing physical therapy to a specified portion of a specified muscle for a movement through a specified range of motion;

placing at least one mounting device on at least one intersection identified on the map for providing physical therapy to the specified portion of the specified muscle for the movement through the specified range of motion;

attaching a first cord to at least one first mounting device, the cord having a pair of ends, a first end of the first cord attaching to a patient and a second end of the first cord attaching to a weight, the at least one first mounting device the first cord and the weight forming a resistance module; and guiding a patient through the specified range of motion of the specified portion of the specified muscle, wherein forming the resistance module is followed by the step of attaching a second cord to at least one second mounting device, a first end of the second cord attaching to the patient at a same place as the first cord and a second end of the second cord attaching to a second weight, the second weight weighing less than the first weight; wherein the at least one second mounting device, the second cord, and the second weight form an assistance module.

2. The method as described in claim 1, wherein the step of forming the resistance module and forming the assistance module includes placing the resistance module and the assistance module symmetrically on the universal cage but asymmetrically weighted.

3. The method as described in claim 2, wherein the step of forming the resistance module and forming the assistance module includes placing the resistance module and the assistance module symmetrically by placing the at least one first mounting device on a first wall directly opposite the at least one second mounting device on a second wall when the resistance module and the assistance module is formed on the side walls, placing the at least one first mounting device on a first panel of the ceiling and placing the at least one second mounting device equidistant from a center of the ceiling where the ceiling panels are conjoined as the at least one first mounting device and the at least one second mounting device are equidistant from the rear wall when the resistance module and the assistance module is formed on the panels of the ceiling, and placing the at least one first mounting device on a first panel of the rear wall and placing the at least one second mounting device equidistant from a center of the rear wall where the rear wall panels are conjoined as the at least one first mounting device and the at least one second mounting device are equidistant from a floor.

4. The method as described in claim 3, wherein the step of guiding the patient through the specified range of motion of the specified portion of the specified muscle is preceded by the step of placing a gurney symmetrically between the side walls by aligning a center of the gurney with a center of the rear wall where a pair of rear panels are conjoined.

5. The method as described in claim 4, wherein the step of placing the gurney symmetrically between the side walls includes suspending the patient placed on the gurney during therapy with a belt, the belt suspended from the ceiling panels by the mounting devices symmetrically placed according the map for providing support to a specific portion of the patient.

* * * * *